US006412627B1

(12) United States Patent
Tiscione et al.

(10) Patent No.: US 6,412,627 B1
(45) Date of Patent: Jul. 2, 2002

(54) CARD HOLDER AND EJECTOR

(76) Inventors: James Allen Tiscione, 445 S. 4th Ave., Tucson, AZ (US) 85701; Anthony Tiscione, 4319 N. Bidahochi Dr., Tucson, AZ (US) 85749

( * ) Notice: Subject to any disclaimer, the term of this patent is extended or adjusted under 35 U.S.C. 154(b) by 0 days.

(21) Appl. No.: 09/755,263

(22) Filed: Jan. 5, 2001

Related U.S. Application Data

(60) Provisional application No. 60/174,570, filed on Jan. 5, 2000.

(51) Int. Cl.[7] ..... A45C 11/18
(52) U.S. Cl. ..... 206/39.4; 150/147
(58) Field of Search ..... 206/39.4, 39.5, 206/39.6, 37.2, 37.3, 37.4; 150/147, 148

(56) References Cited

U.S. PATENT DOCUMENTS 2,640,347 A * 6/1953 Majeski ..... 206/37.2
2,789,613 A * 4/1957 Corsaw ..... 206/37.2
3,109,538 A * 11/1963 Boxer ..... 206/37
3,354,678 A * 11/1967 Stifelman ..... 206/37.2
4,739,897 A * 4/1988 Butler ..... 206/320
4,792,058 A * 12/1988 Parker ..... 221/352
4,852,727 A * 8/1989 Oberle ..... 206/39.4
4,887,739 A * 12/1989 Parker ..... 221/232
5,484,063 A * 1/1996 Cuccio et al. ..... 206/772
5,791,461 A * 8/1998 Tsuge ..... 206/39.4
5,960,944 A * 10/1999 Plocher ..... 206/39.4
6,089,289 A * 7/2000 Florjancic ..... 150/147

* cited by examiner

*Primary Examiner*—Shian Luong
(74) *Attorney, Agent, or Firm*—Gavin J. Milczarek-Desai; Durando Birdwell & Janke, PLC

(57) ABSTRACT

The invention provides a three-dimensional card case including a cavity surrounded by two sidewalls, a rear wall and an opening on the side opposite the rear wall. The cards are inserted into slots at the opening of the cavity until they flush with an ejector tab at the rear wall. This allows a card to be individually ejected by the tab mechanism, which is linked to actuator buttons located on the exterior of the case. Each button is labeled to identify and select a specific card.

14 Claims, 7 Drawing Sheets

58
78F
42
76
80
56
78A 74
72
28
68
62
68
78A
78B
78C
78D
78E
78F
66
A'
76
42
4
12
6
70
66

CARD HOLDER AND EJECTOR

STATEMENT OF RELATED APPLICATIONS

This application is based on U.S. Provisional Application No. 60/174,570, entitled "Card Holder and Ejector," filed on Jan. 05, 2000 by the same inventors.

BACKGROUND OF THE INVENTION

1. Field of the Invention

This invention is related in general to pocket or purse organizers and, in particular, to a device that organizes, stores, and protects wallet-sized cards, such as those containing credit or identification information.

2. Description of the Related Art

Inside a typical wallet or purse, one is likely to find a half-dozen or more cards such as license, credit, check, ATM, and membership cards, amongst others. The usual dimensions of these cards is approximately 8.5 cm in length by 5.5 cm in width and 1 mm or less in thickness. The storing, organizing, and retrieving of wallet-size cards has led to a need for compact, yet efficient, holders.

Standard wallets or purses may contain pockets or inserts of clear plastic envelopes that serve to store or organize cards. However, such features are not ideal for several reasons. First, cards can be difficult to retrieve from, or place into, deep pockets or plastic envelopes. Second, the space available for individual cards frequently is filled to capacity, requiring the storage of a stack of multiple cards in a single pocket or envelope. Thus, retrieval of a particular card is hampered because all cards in a stack must be at least partially removed or displaced during sorting. Moreover, cards can fall out of a purse or wallet pocket, or be fumbled and dropped while one is sorting through a stack to find a particular card.

U.S. Pat. No. 4,697,698 entitled "Credit and Identification Card Holder," issued to Holdener, describes a case for storing wallet-size cards. Each card is located on its own sliding drawer that can be individually advanced and removed from the case. The sliding drawer holds a card in place through the use of stops disposed at the ends of the drawer. In this manner, a card is prevented from falling out.

However, the requirement for the sliding drawer parts of Holdener necessarily augments the thickness of the card holder. Such extra thickness is a problem, in that it is undesirable for a pocket-size card holder to have an more bulk than is needed to store the cards. Accordingly, as highlighted in the last paragraph before the claims of the Holdener patent, the sliding drawer design can result in a card holder that is very awkward to handle if made to accommodate more then 6 cards. Moreover, if the required sliding drawer parts become lost or broken, holder's device would suffer from diminished capacity or be practically unuseable.

Thus, there continues to be a need in the art for a card holder that stores, organizes, protects, and allows easy retrieval of individual cards in a more compactly-designed case, with no separate components to lose or break, then has heretofore been known.

BRIEF SUMMARY OF THE INVENTION

The primary, general objective of this invention is to provide a card holder that stores and organizes wallet-sized cards as compactly as possible.

Another general objective is to simplify the card identification and retrieval process such that individual cards may be selected and ejected from a holder quickly and easily.

Another, more specific, goal of the invention is to provide a compact card holder that does not rely on the use of a sliding drawer mechanism in order to store and access cards inside the holder.

Still another objective is to provide a holder that securely keeps cards inside the holder so as to prevent their accidentally falling out.

Yet another goal is to keep cards protected from becoming damaged or, where appropriate, demagnetized.

Another objective is to efficiently store from 1 to 12 cards in single pocket-size device.

Still another objective is to provide a compact card holder that is inexpensively manufactured from commonly available components.

Therefore, according to these and other objectives, the invention generally provides a compact, portable device designed primarily for the storage, selection and ejection of up to twelve wallet-size cards, such as a driver's license or debit card.

More specifically, the invention provides a three-dimensional, preferably flat and rectangular, case that contains an interior cavity defined by a top piece and a bottom piece connected by two side walls and a rear wall, with an opening at one end of the case. Cards are inserted through the opening into one of several parallel slots disposed in each side wall of the case until they are frictionally engaged, preferably by resilient pads disposed on each side wall, and flush with an ejection tab assembly located at the rear wall of the case. This design allows a card to be individually displaced by a particular tab assembly, which is linked to an actuator button located on the exterior of the case. Preferably, each button is labeled to remind the user of the slot location and identity of the card to be ejected.

Also preferably, the ejection tab assembly is actuated by pushing a spring-loaded button in the direction of the opening of the case. The button is connected to a an U-shaped tab aligned with the back edge of a card. Thus, as the button is slid toward the opening, the end of the U-shaped tab pushes the card forward, extending it out of the device approximately one-half inch so that it may be pulled out for use. Upon releasing the button, the compacted spring returns the button to its original position.

As mentioned above, cards are kept from falling out of the case of the invention by virtue of frictional engagement with a resilient material. While the case itself may provide for such engagement, resilient pads disposed parallel to the side walls of the case and located near the rear wall are preferred. Obviously, however, the frictional engagement force provided by the invention should be less than the ejection force provided by the tab assemblies such that cards may be advanced from the case.

Optionally, the bottom piece of the case may include a permanent or removable clip, which can hold paper currency or attach the case to another object. Moreover, the case of the invention may include one or more card-like accessories adapted to harbor or display a mirror, paper currency, photographs, a nailfile or other items typically carried in a wallet or purse. Finally, a protective cover made of, for example, leather or vinyl may be used in conjunction with the invention.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DESCRIPTION OF THE PREFERRED EMBODIMENTS OF THE INVENTION

The invention generally relates to card holder case that stores and protects standard wallet-sized cards until a user selects and advances a particular card out of the holder by sliding an actuator button linked to an ejection tab that is aligned with the back of the card.

As used herein, the term "wallet-size cards" is meant to include any card, such as license, credit, check, ATM, and membership cards, that are approximately 8.5 cm long by 5.5 cm wide and 1 mm or less thick. The invention may also utilize accessory cards adapted to provide general utility functions, such a reflective surface, a magnifying glass, displaying a photograph, or holding a nail file or paper currency. Of course, as would be obvious to one skilled in the art, the case of the invention may be made to dimensions that are suitable for carrying cards of other dimensions as well.

Figure 1A:
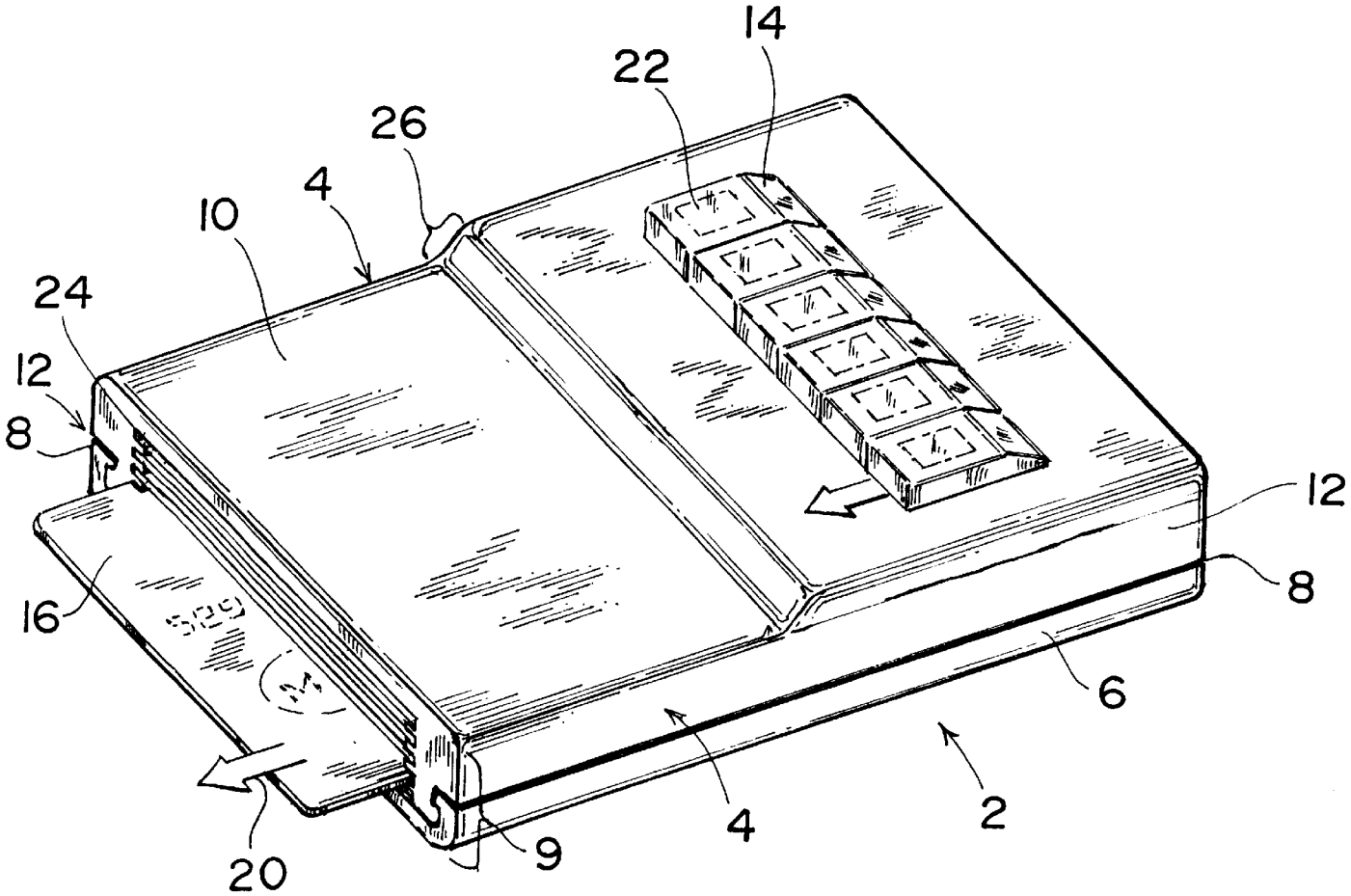
FIG. 1A illustrates schematically a top view perspective of the preferred embodiment of the invention.

Referring to the drawings, wherein like parts are designated throughout with like numerals and symbols, FIG. 1A illustrates schematically a top perspective view of the preferred embodiment of the invention. In general, the body of case 2 includes a top piece 4 and a bottom piece 6 joined together at seam 8, an opening 9, and a rear wall attached to the back of top piece 4 (not shown in this view).

More specifically, the top piece 4 includes an top face 10 and a pair of side walls 12 in parallel connection with the top face 10. Disposed within cut-out sections (not shown) of the top face 10 are buttons 14. Each button 14 actuates the movement of a card 16 by sliding the button in the direction of arrow 18, resulting in the partial ejection of a card 18 in the direction of arrow 20. As show, each button 14 preferably contains a label 22 identifying the card corresponding to a particular slot 24.

Preferably, the top piece 4 further includes a beveled region 26, which corresponds to an elevation of approximately one-quarter inch of the area of the top face 10, which provides space for the structure of the ejection tab assemblies (not shown) without interfering with card placement in slots 24. However, this design choice is not required for the operation of the invention.

Figure 1B:
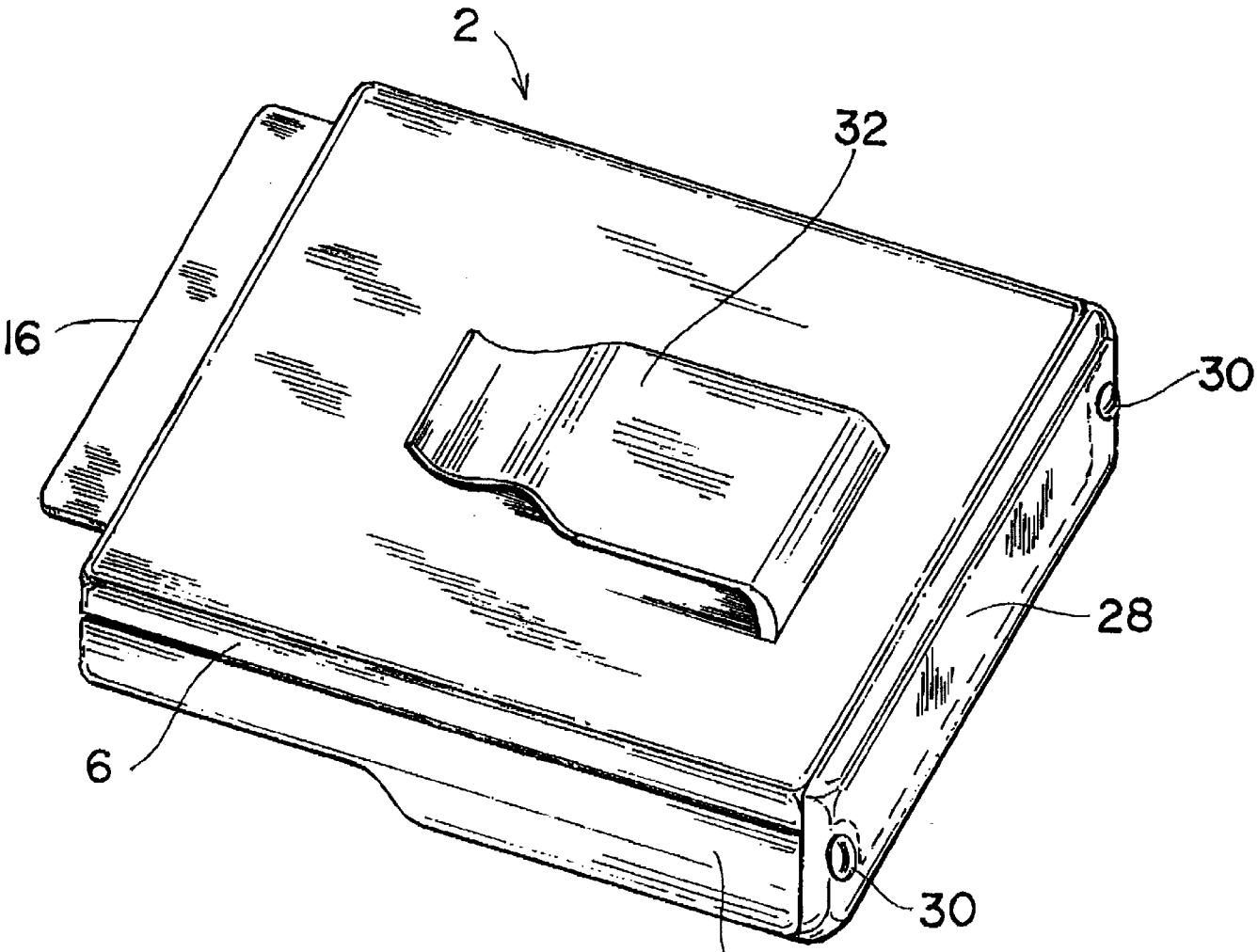
FIG. 1B schematically illustrates a bottom view perspective of the preferred embodiment of the invention, including an optional clip.

FIG. 1B schematically illustrates a bottom perspective view of the preferred embodiment of the invention. In this view, rear wall 28 is apparent. Rear wall 28 is secured by screws 30 to each side wall 12 (to the area shown in phantom line). However, any other means for joining that is known in the art, such as through the use of adhesives or spot welds, may be used in place of screws 30. Clip 32 may be added as an optional accessory and used to hold paper currency or to secured the case 2 to the user by attachment to, for example, the user's clothing. If desired, clip 32 may be made removable by, for example, installing it with a screw.

Figure 2:
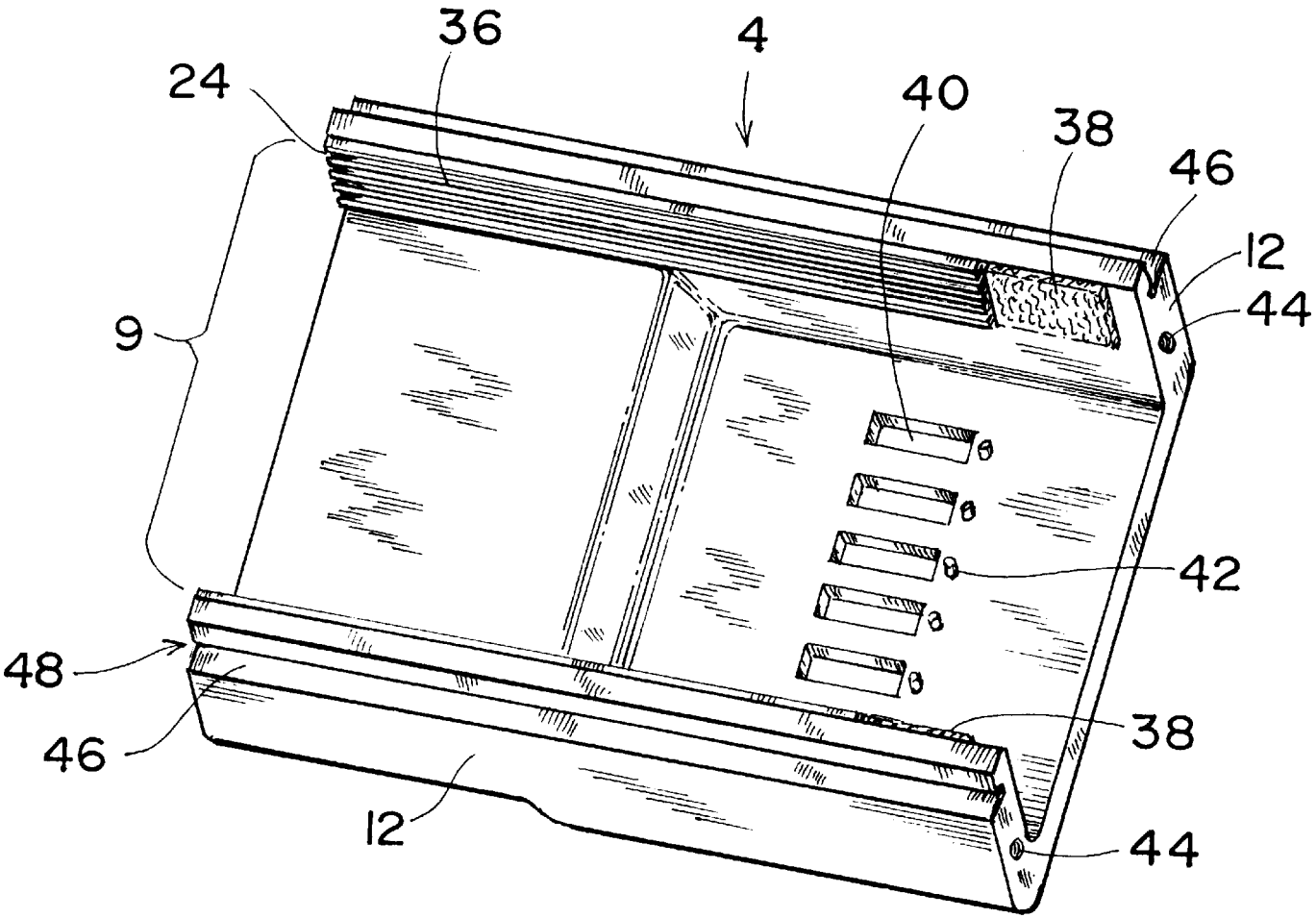
FIG. 2 illustrates schematically the top piece of the embodiment pictured in FIGS. 1A–1B. The top piece has been inverted for the purpose of showing and describing the structure on the interior of the top piece.

FIG. 2 illustrates schematically the top piece of the preferred embodiment by itself, and has been inverted to better show detail on the inside. Six parallel slots 24 on each side wall 12 are formed by grooves 36, which are machined or otherwise formed into the side walls 12 of case 2. The slots 24 on each side wall 12 are arranged so as to be in planer alignment, such that up to six cards (not shown) may be stacked in parallel to one another. Toward the side opposite that of the opening 9, resilient pads 38 are adhered, or otherwise disposed, parallel to each side wall 12.

Pads 38 are generally less then a millimeter thick, extending no further then the width of the slots 24. Also, pads 38 are resilient such that they deform to frictionally engage a card placed into a slot 24. Because different cards can vary in thickness, the resiliency of the pads 38 is key in accommodating and securing a variety of cards in the slots 24. Hence, a card of practically any thickness is held completely inside the case 2 and will not fall out, even if the case is dropped. However, as would be obvious to one skilled in the art, the frictional holding force provided by the pads must be less then the force generated to displace a card.

The top piece 4 also includes a plurality of parallel cut-out sections 40. Cut-out sections 40 provide a space through which each ejection tab assembly (see FIG. 4) is disposed. Preferably, a spring located in a channel of each ejection tab assembly (see FIG. 4) is engaged by a rod 42 that protrudes from the interior of top piece 4 near the distal edge of each cut-out section 40. However, the invention does not require the use of spring-loaded ejection tab assemblies.

Several of the structural features of top piece 4 that enable assembly with the other components of the case 2 also are shown in FIG. 2. Holes 44 allow for the attachment of the rear wall (not shown) to the top piece 4. Furthermore, flat surface 46 and groove 48 on the exterior of each side wall 12 allow the bottom piece 6 of FIG. 3 to slidably engage the top piece 4, making assembly very straightforward.

Figure 3:
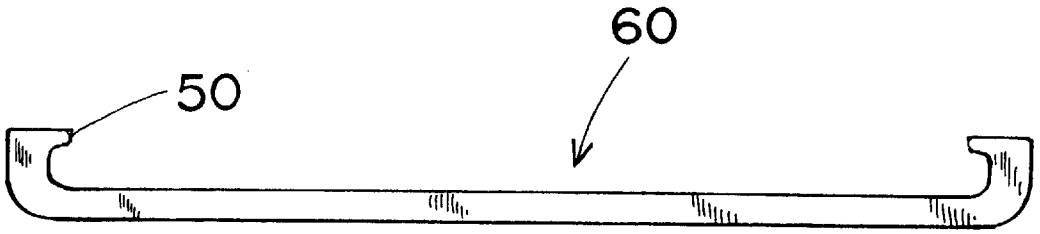
FIG. 3 illustrates schematically a front view of the bottom piece of the embodiment illustrated in FIGS. 1A–1B

FIG. 3 illustrates schematically a front view of the bottom piece of the embodiment illustrated in FIGS. 1A–1B. Bottom piece 6 is essentially U-shaped, and includes a tongue 50 on each end of the U that slides into the grooves 48 of the side walls 12 during assembly.

Figure 4:
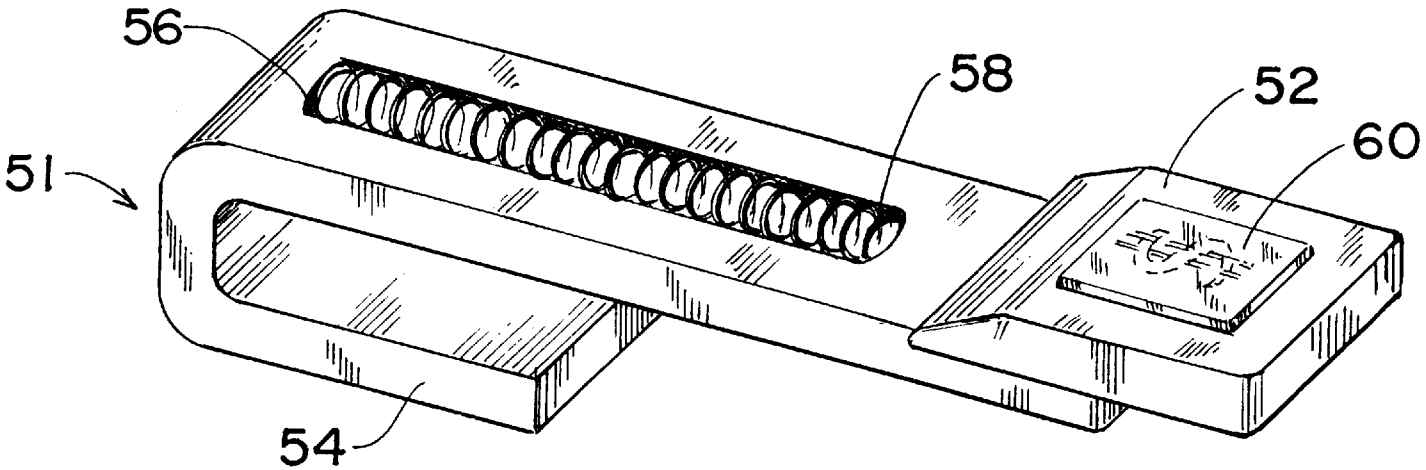
FIG. 4 illustrates schematically a magnified perspective view of the ejection tab assembly of the preferred embodiment.

FIG. 4 illustrates schematically a magnified perspective view of the ejection tab assembly 51 of the preferred embodiment. The assembly 51 includes a button 52 attached to an U-shaped tab 54. Each button 52 is made to be wider then the tab 54 it is attached to, so that the assembly 51 is held within a cut-out section 40 of top piece 4. In addition, each tab 54 is manufactured to be of a particular length such that it is in planar alignment with the position of a particular slot 24 (See FIGS. 6A–6B).

In the preferred ejection tab assembly, the assembly is spring-loaded. Hence, disposed within the top of tab 54 is channel 56. The channel 56 contains a spring 58, which engages a rod 42 of the top piece 4 (illustrated in FIG. 2) such that, when the assembly 51 is pushed in the direction of the case opening, the force provided by the compacting of spring 58 will return the assembly to its original position. An example of a label 60, which identifies the type of card that will be ejected by a particular assembly 51, is also shown.

Figure 5:
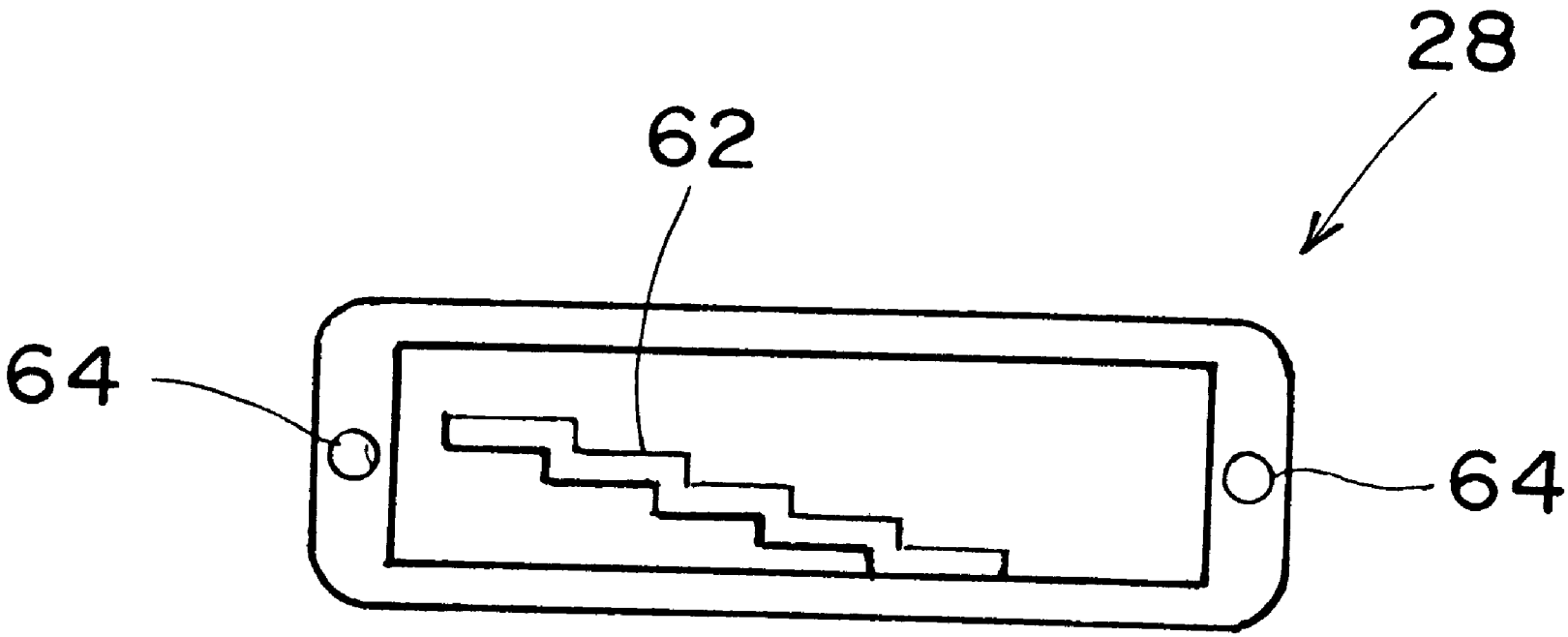
FIG. 5 illustrates schematically a front view of the rear wall of the preferred embodiment pictured in FIG. 1B.

FIG. 5 illustrates schematically a front view of the rear wall 28 of the preferred embodiment pictured in FIG. 1B. Preferably, the rear wall 28 contains a stabilizer bar 62. As shown, the stabilizer bar 62 is stepped in configuration. This stepped configuration helps keep each tab 54 in alignment at a particular slot's location such that operation of an ejection tab assembly remains unimpaired by ordinary wear and tear, such as when the case is dropped.

Figures 6A, 6B:
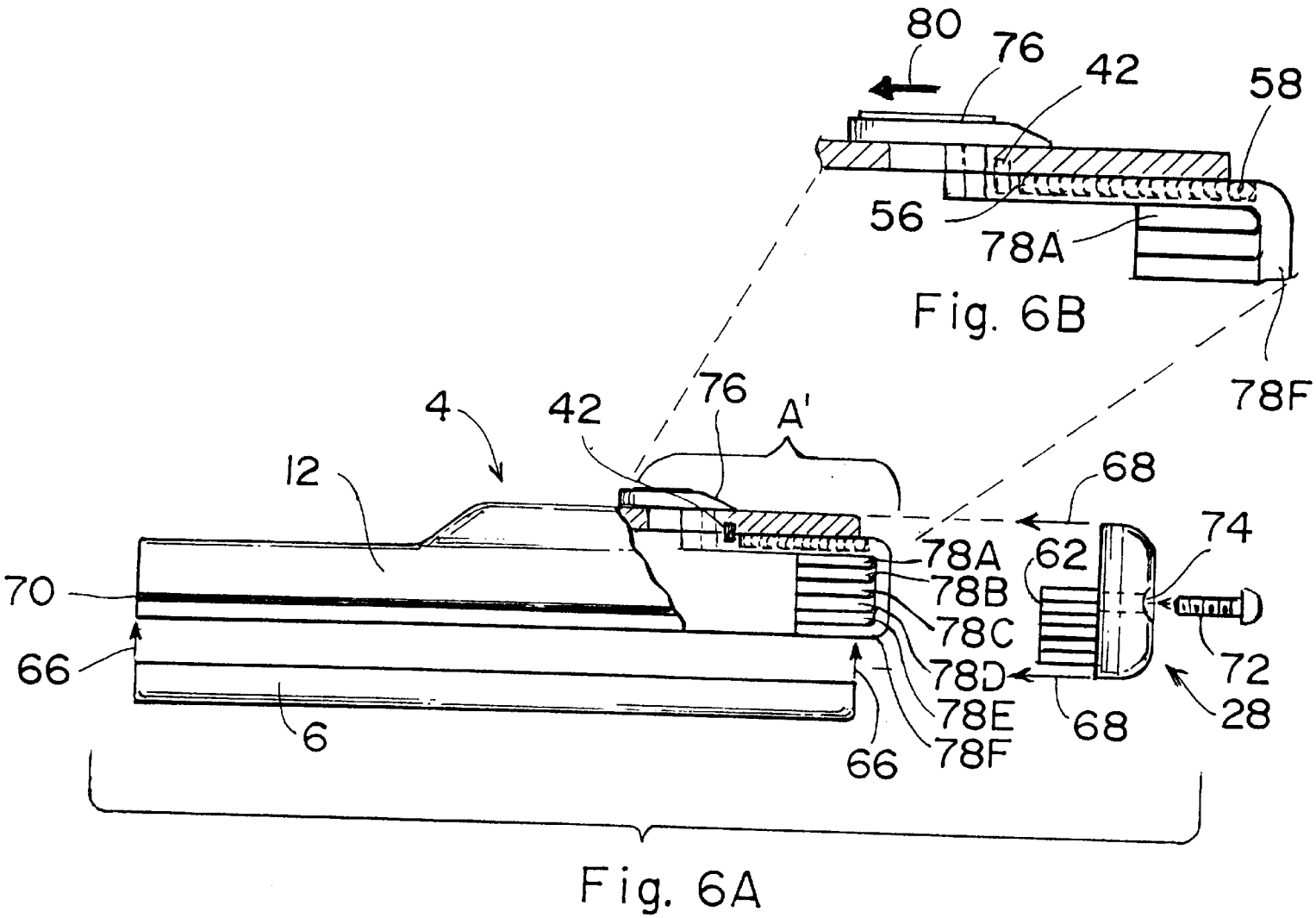
FIG. 6A illustrates schematically a partially-exploded side view of the preferred embodiment of the invention.
FIG. 6B illustrates schematically a magnified view of a portion of cut-away section A', showing the relationship between the spring of the preferred ejection tab assembly and a rod disposed on the top piece of the case.

FIG. 6A illustrates schematically a partially-exploded side view of the preferred embodiment of the invention. The invention is shown disassembled into its three main components, top piece 4, bottom piece 6 and rear wall 28. Arrows 66 and 68 roughly illustrate the order and orientation of the assembly process, i.e., the bottom piece 6 is slid onto the top piece 4 engaging groove 70, followed by the attachment of each end of the rear wall 28 to the top piece 4 via fasteners, such as screw 72 placed through hole 74. Additionally, as shown through cut-away section A' of side wall 12, a button 76 is connected to an tab 78A. Hence, the size and spatial arrangement of each U-shaped tab 78A–78F can be clearly discerned.

FIG. 6B illustrates schematically a magnified side view of cut-away section A'. As depicted, the rod 42 of the preferred embodiment is immersed inside the channel 56 (shown in phantom line) of U-shaped tab 78A, where it contacts spring 58 (shown in phantom line).

Figure 7:
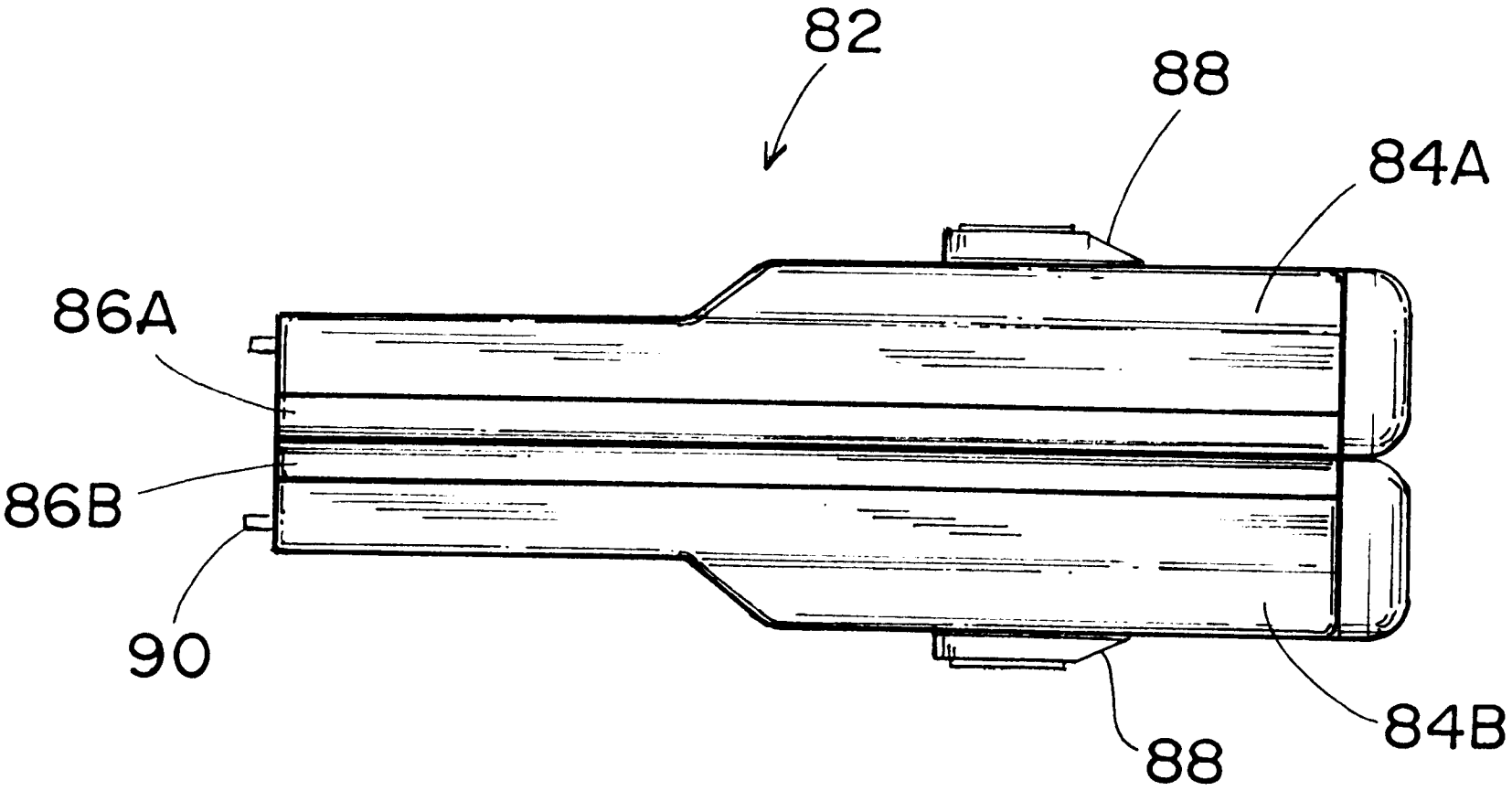
FIG. 7 illustrates schematically an alternate embodiment of the invention.

FIG. 7 illustrates schematically an alternate embodiment of the invention. While the capacity of the illustrated preferred embodiment is shown to be six cards, the case of the invention can be manufactured in a "back-to-back" fashion so as to accommodate up to twelve cards. In other words, the twelve card holder 82 is can simply consist of two cases 84A and 84B that are joined by each bottom piece, 86A and 86B. Accordingly buttons 88 are disposed on each side of case 82 for ejection of a card 90. Alternatively, the twelve card case 82 may be manufactured to share a single common bottom, allowing the case 82 to be as thin as possible.

As would be recognized by one skilled in the art, the cases of the invention may be made of any moldable material, such as plastic, aluminum, stainless steel, or other metals. Preferably, such materials of the cases are also resilient so as to frictionally engage cards place inside.

Various changes in the details, steps and components that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and procedures.

We claim:

1. A holder for a plurality of wallet-sized cards, comprising:

a case, including a top piece and a bottom piece connected by two sidewalls and a rear wall, defining an interior cavity with an opening along an end of said case;

a plurality of parallel slots disposed within the side walls of the case, said slots being adapted to accommodate the wallet-size cards;

a plurality of parallel cut-out sections in the top piece of the case; and a plurality of ejection tab assemblies, each assembly being adapted for slidable movement toward said opening of the case and including a U-shaped member having an end aligned with one of said parallel slots in the direction of said opening, and a button connected to said U-shaped member through one of said plurality of parallel cut-out sections.

2. The holder of claim 1, further comprising a resilient means for frictionally engaging the wallet-size cards within the case.

3. The holder of claim 2, wherein the means for frictionally engaging said cards comprises a resilient pad disposed on a side wall.

4. The holder of claim 2, wherein the means for frictionally engaging said cards comprises the plurality of parallel slots made from a resilient material.

5. The holder of claim 1, further including a protective cover being adapted to fit said holder.

6. The holder of claim 1, further including a clip mounted to the bottom piece of the case.

7. The holder of claim 6, wherein said clip is detachable.

8. A holder for a plurality of wallet-sized cards, comprising:

a case, including a top piece and a bottom piece connected by two sidewalls and a rear wall, defining an interior cavity with an opening along an end of said case;

a plurality of parallel slots disposed within the side walls of the case, said slots being adapted to accommodate the wallet-size cards in direct slidable arrangement within said slots;

a plurality of parallel cut-out sections in the top piece of the case; and a plurality of ejection tab assemblies, each assembly being adapted for slidable movement toward said opening of the case and including a U-shaped member having an end aligned with one of said parallel slots in the direction of said opening, and a button connected to said U-shaped member through one of said plurality of parallel cut-out sections.

9. The holder of claim 8, further including a protective cover being adapted to fit said holder.

10. The holder of claim 8, further including a clip mounted to the bottom piece of the case.

11. The holder of claim 10, wherein said clip is detachable.

12. The holder of claim 8, further comprising a resilient means for frictionally engaging the wallet-size cards within the case.

13. The holder of claim 12, wherein the means for frictionally engaging said cards comprises the plurality of parallel slots made from a resilient material.

14. The holder of claim 12, wherein the mans for frictionally engaging said cards comprises a resilient pad disposed on a side wall.

* * * * *